United States Patent [19]

Tarpley et al.

[11] 4,326,199

[45] Apr. 20, 1982

[54] AUTOREFERENCING LIQUID LEVEL SENSING APPARATUS AND METHOD

[75] Inventors: Roy W. Tarpley, Garland; Larry A. Rehn, Rowlett; Paul H. Davis, Seagoville, all of Tex.

[73] Assignee: Texas Instruments Incorporated, Dallas, Tex.

[21] Appl. No.: 176,836

[22] Filed: Aug. 11, 1980

[51] Int. Cl.[3] ..... G08B 21/00

[52] U.S. Cl. ..... 340/622; 73/295; 137/386; 340/501

[58] Field of Search ..... 340/622, 501, 59; 73/295; 137/386

[56] References Cited

U.S. PATENT DOCUMENTS

| | | | |
|---|---|---|---|
| 3,955,416 | 5/1976 | Waiwood | 73/295 |
| 4,036,053 | 7/1977 | Jenkins | 73/295 |
| 4,163,391 | 8/1979 | Bezard et al. | 73/295 |
| 4,244,050 | 1/1981 | Weber et al. | 340/663 |

*Primary Examiner*—Glen R. Swann, III

*Attorney, Agent, or Firm*—Robert D. Marshall, Jr.; Leo N. Heiting; Melvin Sharp

[57] ABSTRACT

An autoreferencing liquid level sensing apparatus and method determines the presence of a liquid by observation of the convective cooling rate of a heated temperature sensor. The temperature measured by the temperature sensor is compared with an adapting temperature reference whose initial value is determined from the initial measured temperature and whose value increases during the heating at a rate proportional to the rate of heating of the temperature sensor and the initial temperature. This comparison enables discrimination of whether the convective cooling rate of the temperature sensor is above or below a predetermined level. Because the rate of convective cooling depends in large part on the thermal capacity of the fluid surrounding the sensor, the convective cooling rate determination allows discrimination of whether the temperature sensor is surrounded by a gas or a liquid, or surrounded by one of two immiscible liquids having differing thermal properties.

6 Claims, 8 Drawing Figures

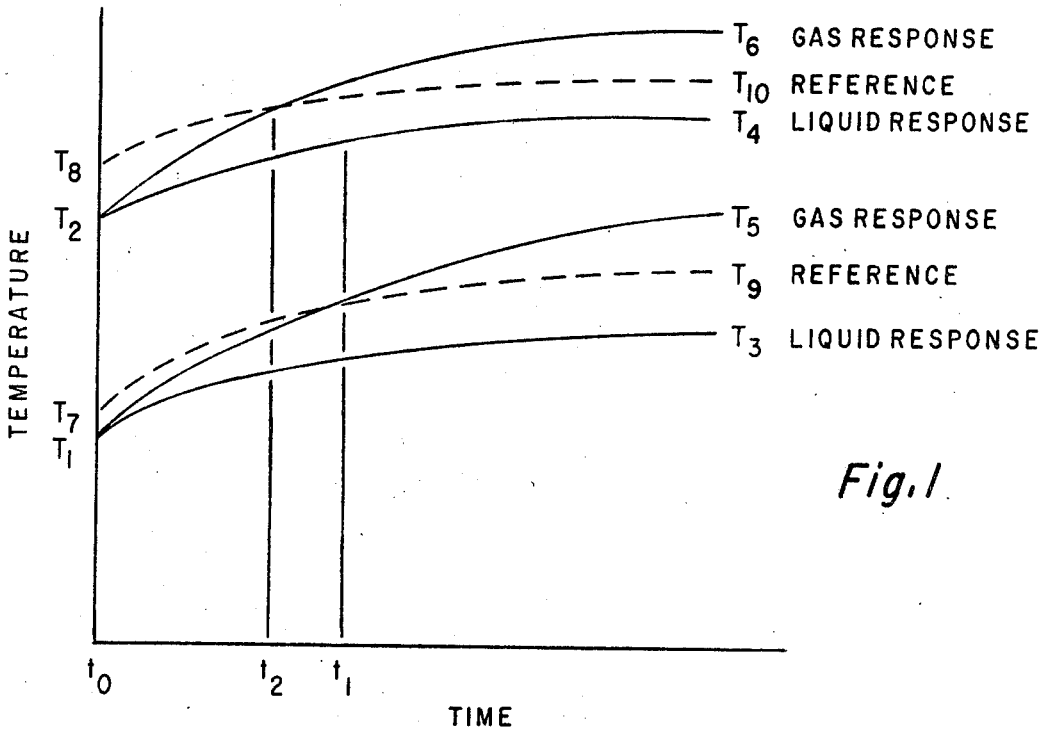
Fig. 1
Fig. 2
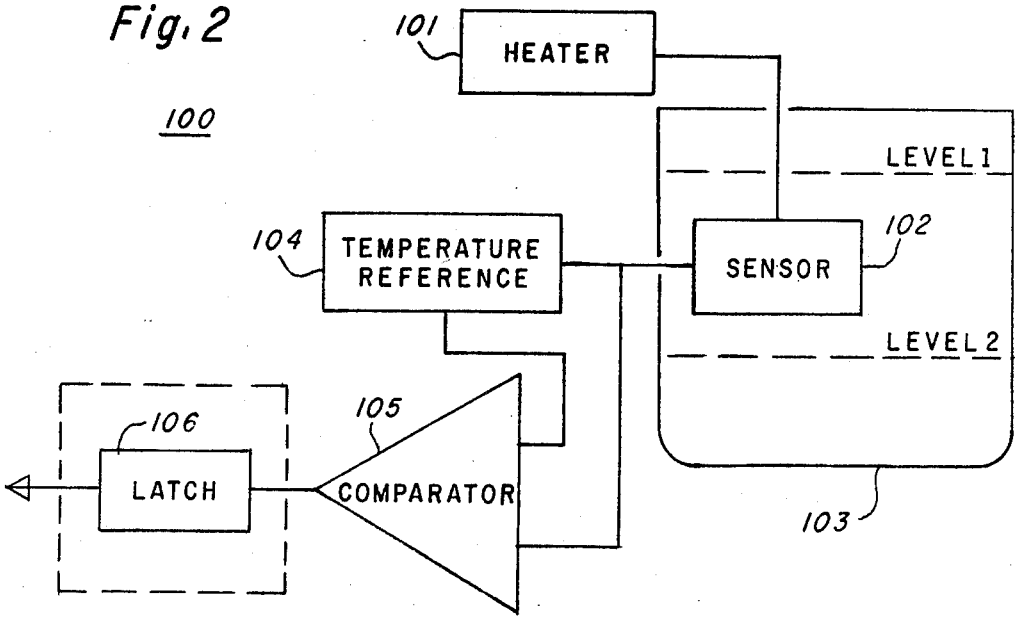

Fig. 3
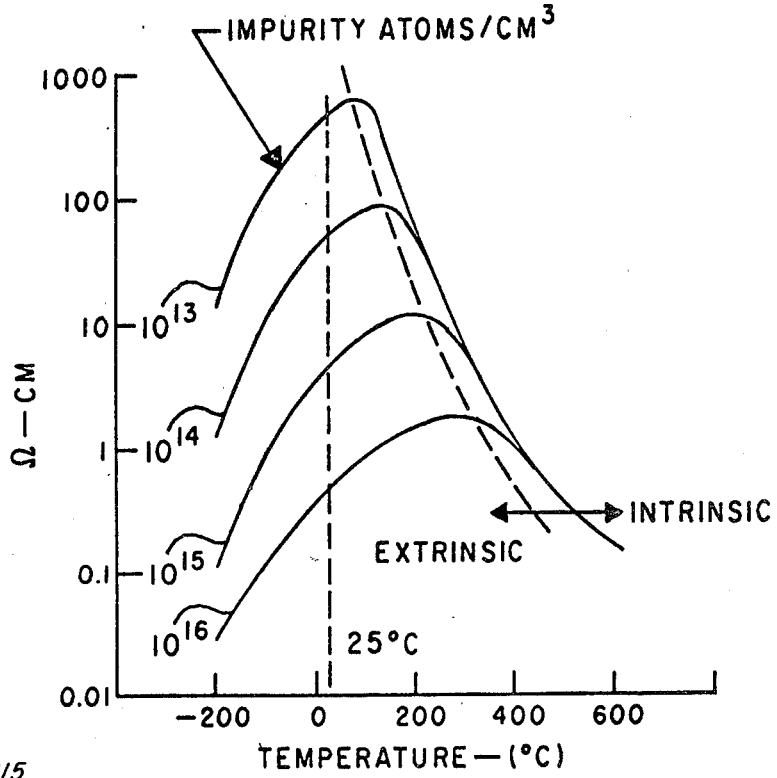
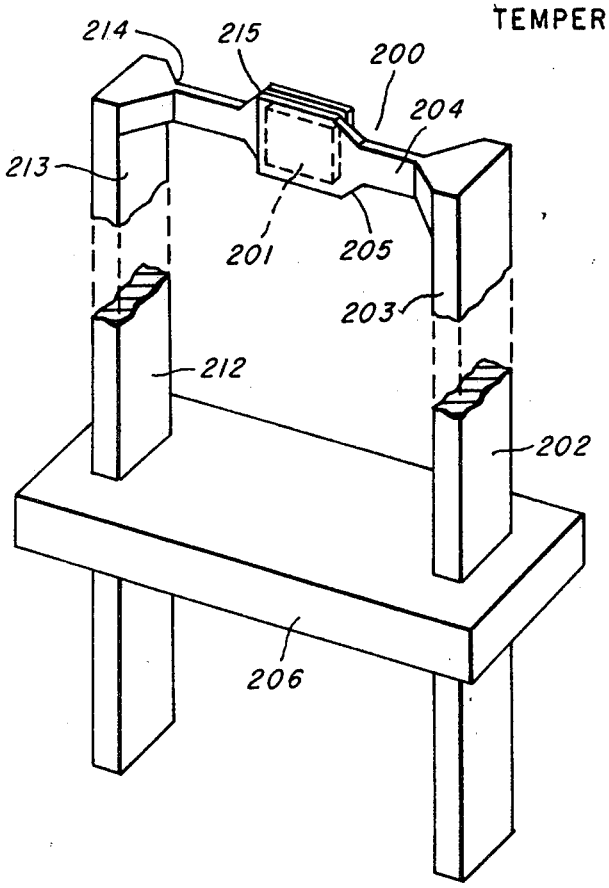
Fig. 4

301
FILTER AND POLARITY GUARD
302
FIRST REGULATOR
303
SECOND REGULATOR
304
SENSOR POWER
305a
305b
REFERENCE NETWORK
306
307
TEMPERATURE REFERENCE
308
COMPARATOR
309
LATCH LOGIC
310
OUTPUT
311
LOW VOLTAGE REGULATOR
312
TIMER

OIL RESPONSE
REFERENCE LEVEL
AIR RESPONSE
-20° C.
OIL RESPONSE
REFERENCE LEVEL
AIR RESPONSE
+125° C.
3.0
2.5
2.0
1.5
1.0
VOLTS
0
0.5
1.0
TIME (SEC.)

AUTOREFERENCING LIQUID LEVEL SENSING APPARATUS AND METHOD

BACKGROUND OF THE INVENTION

The present invention relates to an apparatus and a method for sensing the presence of a liquid by observing the temperature behavior of a heated temperature sensor. The principle of operation of the present invention is to determine whether the sensor is surrounded by a gas or a liquid or to determine which of two immiscible liquids surround the sensor by determining the external thermal load upon the sensor. The thermal load upon the sensor is determined by heating the sensor by application of a predetermined amount of thermal energy and observing the rate of temperature increase of the sensor. If the temperature sensor is surrounded by a gas, there is less thermal conduction away from the sensor than if same sensor was surrounded by a liquid. That is, a gas would absorb less of the thermal energy within the temperature sensor via convection than would the liquid. As a consequence, for a given amount of thermal energy applied to the temperature sensor, the sensor would reach a greater temperature in a gas than in a liquid. A similar condition would occur if the temperature sensor could be immersed in one of two immiscible liquids having differing thermal conductivities. Thus, observation of the rate of temperature increase of the temperature sensor enables a determination of the type of fluid surrounding the sensor.

The above mentioned scheme for determining the presence of a liquid has a problem in that the rate of temperature rise is dependent not only upon the type of fluid surrounding the temperature sensor, but also upon the initial temperature of both the sensor and the fluid. Therefore, in order to employ this method of liquid level sensing, it is necessary to compare the temperature of the temperature sensor with a reference signal which has an initial value dependent upon the initial temperature of the sensor and a rate of change dependent upon both the initial temperature of the sensor and upon the rate of heating of the sensor.

SUMMARY OF THE INVENTION

An object of the present invention is to provide an apparatus and a method for detecting the presence of a liquid having particular predetermined thermal properties by observing the temperature change of a temperature sensor heated at a predetermined rate for a predetermined period of time.

It is another object of the present invention to enable liquid level sensing in a manner described above in which the temperature measured by the temperature sensor is compared with a temperature reference signal which has an initial value related to the initial temperature measured by the sensor and further has a rate of change dependent upon the rate of heating of the sensor and the initial temperature.

It is a further object of the present invention to enable liquid level sensing in the manner described above further including a latching output whenever the temperature measured by the temperature sensor and the temperature reference signal have a predetermined comparative relationship at any time during the predetermined period of time.

It is still a further object of the present invention to provide liquid level sensing in the manner described above in which the temperature sensor is repeatedly heated at the predetermined rate for the predetermined time and then permitted to cool for a further predetermined period of time.

One embodiment of the present invention is an autoreferencing liquid level sensing apparatus including a temperature sensor at the liquid level detection position, a heater, a temperature reference source and a comparator.

A second embodiment of the present invention is an autoreferencing liquid level sensing method including the steps of placing a temperature sensor at the liquid level detection position, adding thermal energy to the temperature sensor, generating a temperature reference signal and comparing the temperature measured by the temperature sensor and the temperature reference signal.

A third embodiment of the present invention is an autoreferencing liquid level sensing circuit for use with a temperature sensor including an electric power regulator, a temperature reference source and a comparator.

In one prefered embodiment of the present invention the temperature sensor is a temperature sensitive resistance element disposed at a position where the liquid level is to be determined, the heating means is an electrical power source applying a predetermined amount of electric power to the resistance means for the predetermined period of time and the temperature reference signal is provided by a capacitor which is initially provided with an electric charge related to the initial temperature and which is discharged towards a fixed voltage throughout the predetermined period of time.

In another preferred embodiment of the liquid level sensor of the present invention, a latch output signal is generated upon detection of a predetermined relationship between a temperature dependent signal and temperature reference signal at any time during the predetermined period of time.

In a further preferred embodiment of the liquid level sensor of the present invention, a voltage regulator provides power at a first predetermined voltage to the electric power source whenever it receives electric power having a voltage greater than a second predetermined voltage and further includes a latch inhibiting function which prevents generation of the latch output signal whenever the electric power received by the voltage regulator has a voltage less than the second predetermined voltage.

BRIEF DESCRIPTION OF THE DRAWINGS

These and other objects of the present invention will become clear from the following detailed description of the invention taken in conjunction with the drawings in which:

FIG. 1 is a graph comparing the temperature of the heated temperature sensor in liquid and gas and the temperature reference for two initial temperatures;

FIG. 2 is an overall system block diagram of the present invention;

FIG. 3 is a graph of the specific resistivity of N-type silicon as a function of temperature;

FIG. 4 is an illustration of one embodiment of the temperature sensor of the present invention;

DETAILED DESCRIPTION OF THE INVENTION

Figure 5:
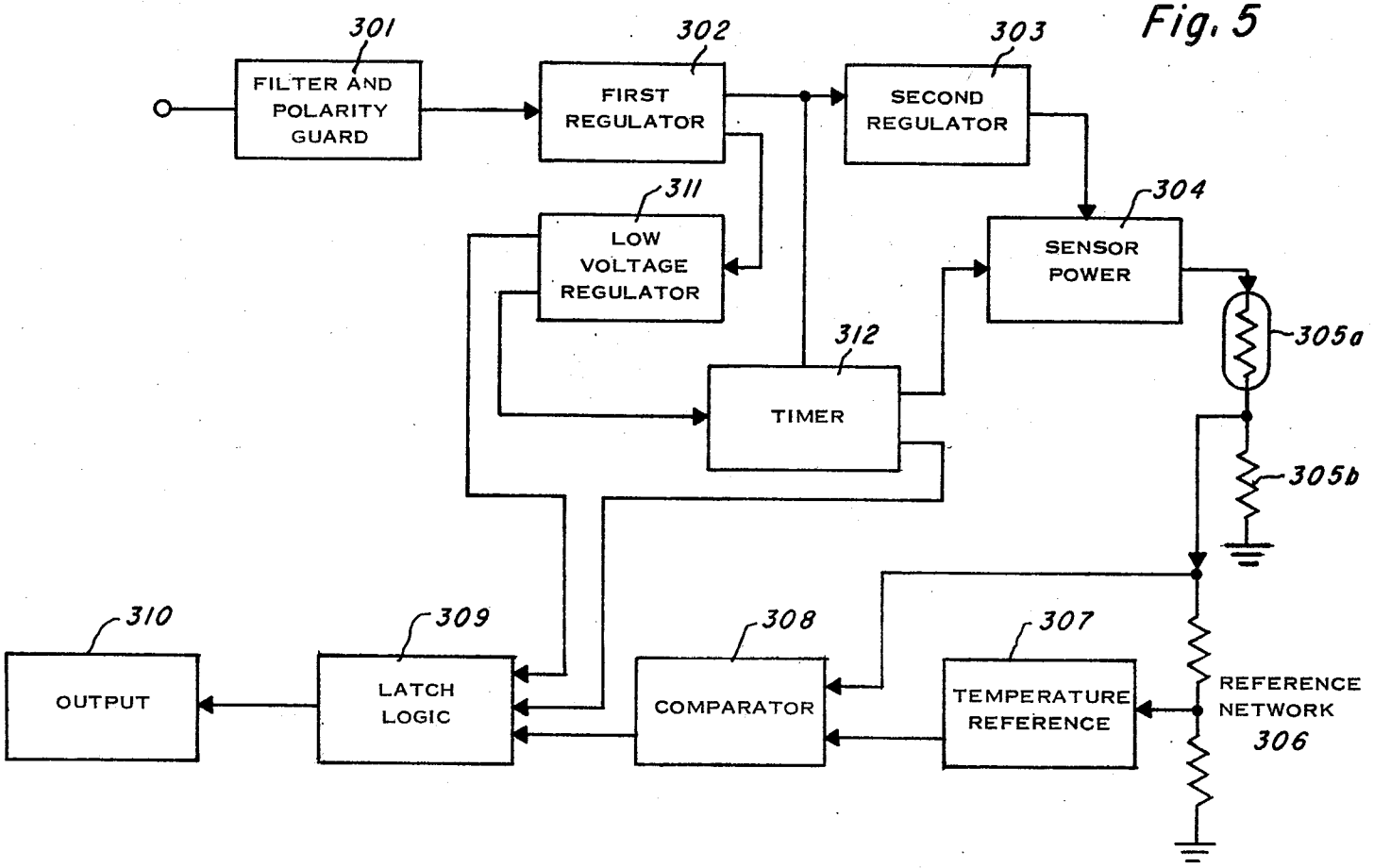
FIG. 5 is a block diagram of a practical embodiment of the present invention employed as an automobile crankcase oil level detector.

The invention of the present application enables discrimination between a liquid and a gas or between two immiscible liquids having differing conductivities and therefore provides a liquid level indication. The principle of operation of the present invention is to determine the external thermal load upon a heated temperature sensor. The temperature sensor is disposed in the liquid container in a position at which it is desired to determine the liquid level. The temperature sensor is then heated at a predetermined rate for a predetermined period of time during which the temperature measured by the temperature sensor is observed. If the temperature sensor is surrounded by a gas, there is a smaller thermal load imposed upon the sensor than if the same sensor were surrounded by a liquid. That is, a gas would absorb less of the heat energy within the temperature sensor via convection than would a liquid. As a consequence, for a given amount of thermal energy applied to the temperature sensor, the sensor would measure a greater temperature gain in a gas than in a liquid. A similar condition would occur if the sensor could be immersed in one of two immiscible liquids having differing thermal conductivities.

An illustrative graph showing the temperature measured by the heated sensor for two differing initial temperatures is shown in FIG. 1. A first set of curves illustrates the measured temperature when the initial temperature is $T_1$. In the case of both the gas response and the liquid response, the measured temperature at time is $t_0$ to $T_1$. For later times, as the temperature sensor is heated, the gas response diverges from the liquid response, reaching higher temperatures than the liquid response throughout the remainder of the heating interval. A similar situation is illustrated for a higher initial temperature $T_2$. It should be clearly understood that the rate of change of each of the liquid and gas temperature response curves illustrated in FIG. 1 is critically dependent upon the rate of heating of the temperature sensor.

With the temperature response curves illustrated in FIG. 1 in mind, it is readily seen that discrimination between the liquid response and the gas response cannot be obtained on the basis of a single fixed reference level. Not only does each response vary with time, but the ultimate temperature reached as well as the rate of change is dependent upon the initial temperature. For example, a temperature reference level of $T_9$ discriminates between the ultimate liquid response temperature $T_3$ and the ultimate gas response temperature $T_5$ for the case in which the initial temperature is $T_1$. However, note that a reference level of $T_9$ does not discriminate between the liquid response and the gas response during a first portion of the predetermined period of heating the sensor. In addition, a reference level of $T_9$ never distinguishes between the responses if the initial temperature is $T_2$, because throughout the interval of heating, both the liquid response and the gas response are greater than this reference level.

As can be seen from a study of the curves illustrated in FIG. 1, the reference necessary to distinguish between the liquid response and the gas response must be both time varying and temperature dependent. An example of such an adapting reference is illustrated in FIG. 1. Note the reference level curve starting at temperature $T_7$ at time $t_0$ and ultimately reaching temperature $T_9$. This curve is initially greater than the initial sensor temperature of $T_1$ and has an ultimate value between the liquid response ultimate value of $T_3$ and the gas response ultimate value of $T_5$. Thus, this reference level crosses the gas response at time $t_1$ and never crosses the liquid response. This reference must be made temperature dependent as illustrated in the reference curve from temperature $T_8$ to temperature $T_{10}$ for the case of an initial sensor temperature of $T_2$. In this case, the reference crosses the gas response at time $t_2$ and never crosses the liquid response. These reference curves may be generated by setting their inital values at some percentage above the initial temperature of the sensor and setting their rate of change to be substantially parallel to the liquid response rate of change for the corresponding initial temperature. In such a case the liquid response would never cross the reference level, whereas the initial value of the reference level can be set so that the gas response will cross the reference level at some point during the heating interval. This requires some reference source which models the liquid response temperature gain of the sensor during the heating interval. Although it is not illustrated in FIG. 1, it is equally clear that another type of adapting reference may be employed. By setting the initial reference level at a percentage below the initial temperature and providing a rate of change to the reference level substantially parallel to the gas response, the reference level will cross the liquid response at some point during the heating interval, but will never cross the gas response. Reference curves of this type are not illustrated in FIG. 1 for the purpose of clarity.

It is should be clearly understood that the situation illustrated in FIG. 1 is equally applicable to the case in which the temperature sensor may be surrounded by one of two immiscible liquids. In such a case the gas response curves illustrated in FIG. 1 would correspond to the response curves of the liquid having the lower thermal cnductivity.

FIG. 2 illustrates a block diagram of the present invention generally designated by the reference 100. Heater 101 applies thermal energy to sensor 102 at a predetermined rate for a predetermined period of time. Sensor 102 is disposed in liquid vessel 103 at a position to distinguish between Level 1 of the liquid and Level 2 of the liquid. The resulting temperature dependent signal of sensor 102 is applied to both temperature reference 104 and comparator 105. Temperature reference 104 samples the initial temperature measured by sensor 102 and then produces the proper temperature reference signal such as illustrated in FIG. 1. Because the temperature reference signal is set at an initial value corresponding to the initial temperature dependent signal, this technique is called autoreferencing. The temperature dependence signal of sensor 102 and the temperature reference signal of temperature reference source 104 are both applied to comparator 105 which produces an output indicative of their relative levels. This comparator output signal may be employed directly or it may be fed to an optional latch circuit such as a latch 106 enclosed in the dashed lines. Latch 106 would provide a latch output response if the crossing condition ever occurred during the heating interval. In the case of the reference levels such as illustrated in FIG. 1, latch 106 would provide the latch output signal if the comparator output signal ever indicated that the temperature dependent signal was greater than the temperature reference signal. As illustrated in FIG. 1, such a condition would indicate that the level of liquid in vessel 103 is below the position of sensor 102, and therefore the sensor was surrounded by gas.

It has been found convenient in embodiment of the present invention to employ a temperature sensitive resistance element for sensor 102. This choice of temperature sensor 102 enables embodiment of heater 101 with an electric power source. This electric power source would apply a predetermined amount of electric power to the sensor for the predetermined heating interval causing Joule heating in the temperature sensitive resistance element.

One preferred embodiment of the temperature sensitive resistance element employed as sensor 102 includes a doped silicon bulk resistor element. This temperature sensitive resistance element is constructed according to principles illustrated in FIGS. 3 and 4. The silicon used in the silicon bulk resistor element has a carefully controlled impurity concentration of a specific element. Control of this impurity concentration enables substantial control of the temperature dependent resistance characteristics of the resistance element as illustrated in FIG. 3. FIG. 3 illustrates the specific resistivity of N-type silicon as a function of temperature for various donor impurity concentration levels. A donor impurity atom is an atom which provides an additional electron when bound within the silicon crystalline structure. Within the intrinsic region, the specific resistivity is independent of the impurity concentration level. Within this region, the silicon exhibits a negative temperature coefficient of resistance, that is, the resistance decreases with increasing temperature. Within the extrinsic region, the specific resistivity of the silicon depends upon the impurity concentration level. Within the region, the temperature coefficient of resistance is positive, that is, the resistance increases for increasing temperature. This relation is clearly illustrated in FIG. 3 for each of several different impurity concentration levels. As can be seen from the curves illustrated in FIG. 3, selection of the impurity concentration enables selection of the specific resistivity of the silicon employed (note the various specific resistivities at the reference temperature of 25° C.) and also enables selection of the temperature at which the silicon switches from the extrinsic to the intrinsic region. The silicon bulk resistor employed in the sensor of the present invention has an impurity concentration causing an extrinsic positive temperature coefficient of resistance throughout the expected range of operating temperatures.

The structures of the preferred embodiment of the temperature sensitive resistance element of the present invention is illustrated in FIG. 4. The temperature sensitive resistance element as a whole is designated 200. It includes a silicon bulk resistor 201, shown in dashed lines in FIG. 4. The bulk resistor 201 is sandwiched between electrodes 202 and 212. Electrode 202 includes a thick vertical portion 203, a thinner horizontal portion 204 and a contact paddle 205 which is in contact with one surface of bulk resistor 201. Similarly, electrode 212 includes thick vertical portion 213, thinner horizontal portion 214 and paddle 215. The electrodes 202 and 212 are embedded in a plastic spacer 206 which serves to provide mechanical stability for the entire structure. The temperature sensitive resistance element may be mounted via spacer 206 and electrodes 202 and 212 may be connected to an electric power source serving as heater 101. This electric power causes Joule heating of bulk resistor 201. The temperature of the temperature sensitive resistance element is indicated by the resistance of bulk resistor 201. This resistance may be determined by measuring the voltage applied to the sensor and the current flowing through the sensor.

The block diagram of a practical circuit employing the present invention used as an automobile crankcase oil level indicator is illustrated in FIG. 5. The apparatus is connected to the automobile DC power supply through filter and polarity guard 301. Filter and polarity guard 301 provides protection against inadvertent misconnection of the apparatus in a reverse polarity and provides some filtering for any AC components in the automobile's DC power supply. Filter and polarity guard 301 feeds power to first regulator 302. The first regulator 302 provides a relatively stable DC output voltage from the automobile DC power supply, because the automobile power supply is known to exhibit wide voltage swings. The output of first regulator 302 is coupled to second regulator 303 which provides a further stabilized DC voltage. This further stabilized DC voltage is applied to sensor power 304. Sensor power 304 is coupled to sensor network 305 and provides the predetermined electric power during the heating interval. Sensor network 305 is a voltage divider including temperature sensitive resistance element **305*a* and a resistor 305*b*. Temperature sensitive resistance element 305*a* is disposed in the automobile crankcase at a position corresponding to the one-quart low oil level. This position has been selected as a convenient position for generating a warning signal to the driver concerning the oil level. The voltage at the node of the sensor network 305 between temperature sensitive resistance element 305*a* and resistor 305*b* is applied to both a reference network 306 and comparator 308. Reference network 306 is also a voltage divider which applies a percentage of the voltage of the node of sensor network 305 to temperature reference 307. As will be explained in greater detail below, this connection serves to set the temperature reference at the proper initial value in relation to the initial temperature measured by temperature sensitive resistance element 305*a* as required by the autoreferencing technique of this invention. Comparator 308 receives the signal from the node of sensor network 305 and a temperature reference signal from temperature reference 307. As explained in further detail below, comparator 308 provides a comparator output signal if the voltage of the node of sensor network 305 falls below the temperature reference signal from temperature reference 307. This comparator output is applied to latch logic 309 which produces a latch output signal to output 310 if comparator 308 ever generates the comparator output signal during the heating interval. Low voltage detector 311 receives a signal from first regulator 302 and applies signals to latch logic 309 and timer 312. It has been discovered that the automobile DC power supply voltage may occasionally momentarily fall so low that either comparator 308 or latch logic 309 would inadvertently trigger an erroneous output. Low voltage detector 311 determines when the voltage applied to the apparatus is so low that such an erroneous output may be produced and serves to inhibit the action of latch logic 309 during this low voltage condition. Timer 312 provides outputs to sensor power 304 and latch logic 309. Timer 312 thus sets the predetermined heating interval during which sensor power 304 applies the predetermined heating power to the temperature sensitive resistance element 305***a*. In addition timer 312 also provides a signal to latch logic 309 so that latch logic 309 is enabled only during the heating interval. Timer 312 receives a signal from low voltage detector 311 which serves to slow or suspend the timing operation during a low voltage condition. This function is provided because during the time in which the low voltage detector determines that latch logic 309 may be falsely triggered due to the low supply voltage, the amount of power applied to temperature sensitive resistance element 305*a* from sensor power 304 is below the predetermined amount of power. Thus this function provides a time out operation during which the function of the apparatus is largely suspended awaiting return of normal power levels.

Figure 6:
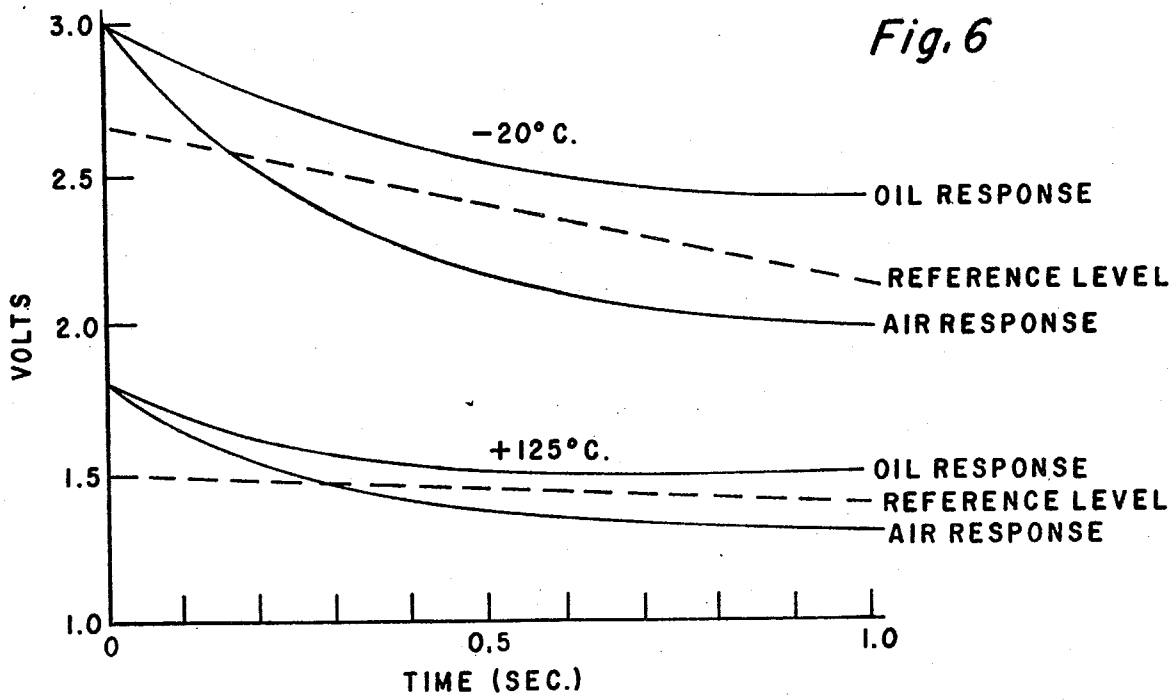
FIG. 6 is an illustration of the typical sensor network voltage for oil response, air response and the reference level at two different temperatures.

FIG. 6 illustrates the typical voltage response at the node of the sensor network together with the temperature reference at two initial temperature levels. Note that because temperature sensitive resistance element 305*a* has a positive temperature coefficient of resistance throughout the region of expected temperatures, increasing temperature means an increasing resistance for temperature sensitive resistor 305 and therefore a decrease in the voltage level at the node. Therefore, the initial voltage of the node is lower at 125° C. than at −20° C. as illustrated in FIG. 6. Also please note that the voltage response curves slope downward during the heating interval also indicating a decreasing node voltage for higher sensor temperatures. Reference network 306 enables the temperature reference to be set at a percentage of the sensor network node voltage as illustrated in FIG. 6. Once set at this initial value, the temperature reference signal then has a decreasing value, indicating an increasing reference temperature, as illustrated in FIG. 6. Also note that the rate of change of the temperature reference signal is dependent upon the initial value.

Figure 7:
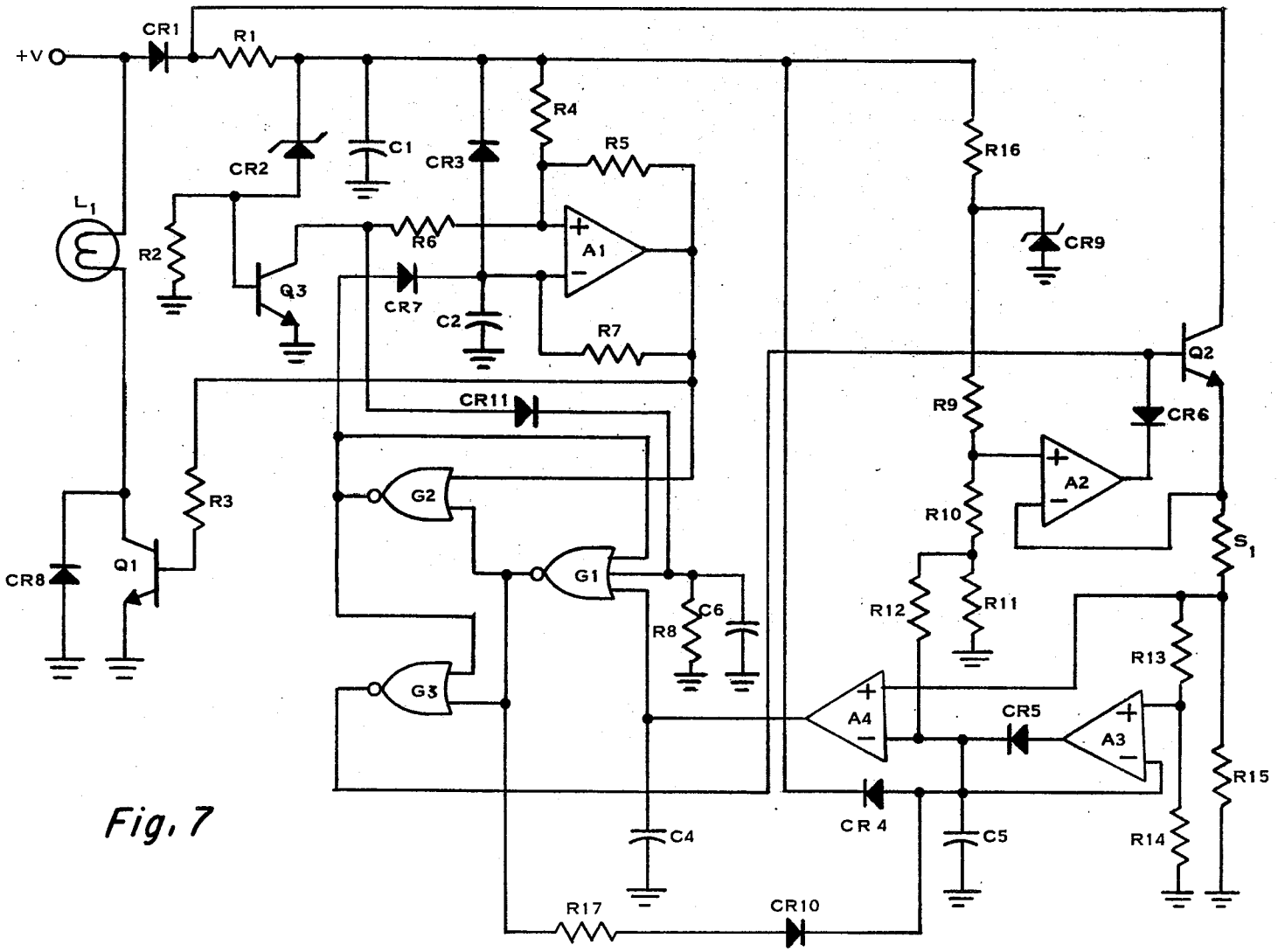
FIG. 7 is a practical circuit diagram of the present invention employed as a crankcase oil level detector.

FIG. 7 illustrates a practical circuit diagram of the oil level sensing circuit system illustrated in FIG. 5. The circuit of FIG. 7 employs lamp L1 for indicating the output results. Because the engine oil level becomes unstable due to splashing shortly after beginning engine operation, the circuit illustrated in FIG. 7 is designed to check the oil level once each time the engine is turned on. Lamp L1 is employed as an output indicator. The circuit is designed to flash lamp L1 once when power is first applied as a system check. If the circuit detects the sensor S1 is above the oil level, that is if the circuit determines that the oil is below the one-quart low point in the crankcase, lamp L1 is driven in a flashing mode to indicate the low oil level.

The filter and polarity guard 301 of FIG. 5 is provided by diodes CR1 and CR8 in FIG. 7, and the combination of resistor R1 and capacitor C1. Please note that if the circuit is inadvertently connected in the reverse polarity, diode CR1 is reverse biased preventing application of the reverse polarity voltage to most of the circuit while diode CR8 is forward biased turning on lamp L1. The first regulator function is provided by resistor R16 and zener CR9. Zener diode CR9 reduces the voltage swing on the line between resistor R1 and resistor R16 by clamping the voltage appearing at the other terminal of resistor R16. In addition zener diode CR9 provides a stable voltage for driving the voltage divider network comprising resistors R9, R10 and R11. The function of this divider will be described in detail below.

Upon initial turn-on of the system, capacitor C1 is discharged. Therefore, initially the voltage across zener diode CR2 is less than its reverse breakdown voltage. Therefore, no signal is applied to the base of the transistor Q3. Transistor Q3 is thus turned off. This has two effects. Firstly, a voltage derived from the voltage source is applied to the noninverting input terminal of operational amplifier A1 via diode CR1 and resistors R1 and R4. Diode CR3 is provided to discharge capacitor C2 when power is off. Because there is no charge stored upon capacitor C2 initially, the noninverting input terminal of operational amplifier A1 is at a greater voltage than its inverting input terminal. Thus, the output of operational amplifier A1 is driven to the supply voltage. This applies a base current through R3 to transistor Q1 turning on lamp L1. The output of operational amplifier A1 is also applied to one input of NOR gate G2 thereby causing the output of NOR gate G2 to be a logical low. Secondly, because transistor Q3 is turned off, a current derived from the supply voltage is applied to the time constant circuit composed of capacitor C6 and resistor R8 through diode CR11. This places an initial charge into capacitor C6 which places a logical high signal on one input of NOR gate G1. This forces the output of NOR gate G1 to be a logical low. Thus the inital period during which transistor Q3 is turned off serves to initialize the logical states of both NOR gates G1 and G2.

After the power has been applied to the circuit for a short period of time, capacitor C1 charges to a voltage greater than the reverse breakdown voltage of zener diode CR2. This causes a current to flow through the back biased zener diode CR2 and resistor R2 to ground. This places a base voltage on transistor Q3, thereby turning this transistor on. Immediately thereafter one end of resistor R6 is grounded through transistor Q3 and diode CR11 is reverse biased. At this time, operational amplifier A1 begins to function as a timer in a manner which will be described in further detail below.

After the initialization of NOR gates G1 and G2 caused by the initial off period of transistor Q3, both NOR gates G1 and G2 apply logical low signals to the inputs of NOR gate G3. This causes the output of NOR gate G3 to be a logical high. This signal is applied to the base of transistor Q2 thereby turning this transistor on to supply current through temperature sensitive resistance element S1 and the parallel combination of resistor R15 with the resistors R13 and R14. Operational amplifier A2 serves to control the amount of electric power flowing through transistor Q2. A voltage reference is provided by the combination of zener diode CR9 and the resistance divider network comprised of resistors R9, R10 and R11. This circuit provides a predetermined voltage at the node between resistors R9 and R10 which is applied to the noninverting input of operational amplifier A2. The inverting input of operational amplifier A2 is connected to the node between the emitter of transistor Q2 and temperature sensitive resistance element S1. Operational amplifier A2 thus controls the base bias applied to transistor Q2 through diode CR6 in order to keep the voltage at the node between the emitter of transistor Q2 and temperature sensistive resistance element S1 at a value very close to the voltage applied to the noninverting input of operational amplifier A2.

Temperature sensitive resistance element S1 and resistor R15 from a sensor network such as sensor network 305 illustrated in FIG. 5. The node between temperature sensitive resistance element S1 and resistor R15 is connected to the noninverting input of operational amplifier A4 which serves as a comparator.

The temperature reference circuit includes operational amplifier A3, diode CR5, capacitor C5 and resistor R12. The sensor network node is connected to one end of a voltage divider circuit including resistor R13 and resistor R14 which form the reference network 306 illustrated in FIG. 5. Upon initial turn on of transistor Q2, the voltage appearing at the sensor node is a measure of the initial temperature of temperature sensitive resistance element S1. A percentage of this voltage is applied to the noninverting input of operational amplifier A3 through the reference network. Diode CR4 is provided to discharge capacitor C5 when power is off. Because capacitor C5 is initially discharged, the output of operational amplifier A3 is driven to the positive supply voltage. This output of operational amplifier A3 serves to charge capacitor C5 through diode CR5 until the voltage on capacitor C5 equals the voltage at the reference network node. As temperature sensitive resistance element S1 begins to heat, the voltage on the sensor network node begins to drop (see FIG. 6). Thus, the voltage applied to the noninverting input of operational amplifier A3 drops to the predetermined percentage of this reduced sensor node voltage. This drop causes the output of operational amplifier A3 to drop to ground. Ordinarily, this drop in voltage would serve to discharge capacitor C5, thus reducing the voltage applied to the inverting input of operational amplifier A3 until it equals the voltage of the reference network node. However, when the output of operational amplifier A3 drops below the voltage stored on capacitor C5, the diode CR5 is reverse biased and capacitor C5 cannot be discharged in this manner. Instead, the charge stored in capacitor C5 is discharged through resistor R12 to the reference voltage appearing at the node between resistors R10 and R11. The resistance of resistor R12 is selected to be so much greater than the resistance of resistors R10 and R11 that current flowing through resistor R12 has little effect upon the voltage at this node. Thus, the voltage on capacitor C5 is initially a fixed percentage of the temperature dependent signal appearing at the node of the sensor network and decreases in the manner illustrated in FIG. 6. Operational amplifier A4 serves as the comparator. The noninverting input is connected to the sensor network node and thus has the temperature dependent signal applied thereto. The inverting input of operational amplifier A4 is connected to capacitor C5 and thus has the temperature reference signal applied thereto. Initially the temperature reference signal is a predetermined percentage of the temperature dependent signal (see FIG. 6), and thus the output of operational amplifier A4 is driven to the positive supply voltage. This serves to charge capacitor C4 to the positive supply voltage. This signal is in turn applied to one input of NOR gate G1.

The timer function of operational amplifier A1 and its associated circuitry will now be described in detail. After the initial charging of capacitor C1, transistor Q3 is turned on. This serves to ground one end of resistor R6, thus forming a voltage divider circuit including resistors R4 and R6. The voltage at the junction of these resistors, which is fixed percentage of the supply voltage, is fed to the noninverting input of operational amplifier A1. Capacitor C2 is connected to the inverting input of operational amplifier A1. Because capacitor C2 is initially discharged, the voltage applied to the noninverting input terminal of the operational amplifier is greater than the voltage applied to the inverting input terminal upon initial power up. Therefore, the output of operational amplifier A1 is driven to the positive supply voltage. As explained above, this has the effect of applying a base bias current to transistor Q1 through resistor R3 thereby turning on lamp L1. In addition, the output of operational amplifier A1 is applied to NOR gate G2 thereby forcing the output of NOR gate G2 to a logical low. In addition, in response to the logical state initiation function described above, the output of NOR gate G1 is also forced to a logic low. These two outputs are applied to the inputs of NOR gate G3. This forces the output of NOR gate G3 to a logical high, thereby turning on transistor Q2 and applying power to the temperature sensitive resistance element S1.

While the circuit remains in this state, the voltage applied to the noninverting input terminal of operational amplifier A1 is determined by a voltage divider circuit including the parallel combination of resistors R4 and R5, which are connected between the power supply voltage and the noninverting input, and resistor R6, which is connected between the noninverting input and ground. Because the output of operational amplifier A1 has been driven to the positive supply of voltage, capacitor C2 is charged through resistor R7. In this state, because the output of NOR gate G2 is a logical low condition, diode CR11 is back biased and therefore has no effect upon the charging of capacitor C2. This charging process will continue until capacitor C2 is charged to a voltage greater than the voltage applied to the noninverting input of operational amplifier A1 via the voltage divider circuit. In this state, the output of operational amplifier A1 switches to become ground. Thus, operational amplifier A1 provides a timed output, whose length of time is set by the length of time it is required to charge capacitor C2 to the voltage set upon the noninverting input of operational amplifier A1 via the voltage divider circuit.

In the case in which the temperature sensitive resistance element S1 is covered by oil, the temperature dependent signal is always greater than the temperature reference signal throughout the predetermined interval set by the timing function described above (see FIG. 6). In such a case, the output of operational amplifier A4 remains at the positive supply voltage throughout the interval set by operational amplifier A1 and its associated circuitry. Thus, capacitor C4 is fully charged to the positive supply voltage when the output of operational amplifier A1 switches from the positive supply voltage to ground. When the output switching of operational amplifier A1 occurs, a bias current is no longer applied to transistor Q1. As a result, lamp L1 is turned off. In addition, a logical low signal is applied to one input of NOR gate G2. Because NOR gate G1 also applies a logical low signal to the other input of NOR gate G2, the output of NOR gate G2 switches to a logical high. This has the effect of changing the output state of NOR gate G3 to a logical low state. Therefore, a base bias current is no longer applied to the input of transistor Q2 (note that no bias current can come from operational amplifier A2 because diode CR6 blocks any such current), therefore power is no longer applied to the sensor network. The logical high input of NOR gate G2 is applied to one input of NOR gate G1, thereby insuring that the output of NOR gate G1 remains a logical low. In this state NOR gates G1 and G2 are latched, that is, they have achieved a stable state which is not altered by further operation of the circuit. Capacitor C4 is provided to insure that a logical high signal is applied to one input of NOR gate G1, thereby keeping its output at a logical low level, until a reliable latch up is achieved regardless of the output state of the comparator operational amplifier A4. The logical high output signal from NOR gate G2 is applied to capacitor C2 through the now forward biased diode CR7. The voltage divider resistors R4, R5 and R6 are selected to insure that the voltage applied to the noninverting input of operational amplifier A1 in this state is always less than the thus achieved voltage on capacitor C2. Therefore, the output of operational amplifier A1 remains pinned to ground and lamp L1 remains off. Thus when the level of oil in the engine crankcase is above the position of temperature sensitive resistance element S1, lamp L1 lights during the heating period and is then turned off. Thus no low oil level signal warning is generated.

When the oil level in the crankcase is below the position of temperature sensitive resistance element S1, then some time during the interval set by the timer function the temperature dependent signal falls below the temperature reference signal (see FIG. 6). Thus some time before capacitor C2 is charged to the voltage applied to the noninverting input of operational amplifier A1 and while the output of operational A1 is held at the power supply voltage, the output of operational amplifier A4 switches from the power supply voltage to ground. This discharges capacitor C4, thus applying a logical low signal to the associated input of NOR gate G1. Because the output of operational amplifier A1 remains at the positive supply voltage, a logical high is applied to one input of NOR gate G2, thereby forcing its output to a logical low state. This logical low is applied to a second input of NOR gate G1. After the initial power up signal applied to capacitor C6, this capacitor is discharged through resistor R8. Each of the three inputs to NOR gate G1 are logical lows and therefore the output of NOR gate G1 becomes a logical high. This logical high output is applied to one input of NOR gate G2, thereby forcing its output to a logical low. In addition, this output is also applied to one input of NOR gate G3, forcing the output of NOR gate G3 to a logical low and turning off sensor power through transistor Q2. Capacitor C5 is charged to the logical high output level of NOR gate G1 through transistor R17 and diode CR10. This insures that the voltage applied to the inverting input terminal of operational amplifier A4 is always greater than the voltage applied to the noninverting input terminal, thus assuring that capacitor C4 is always discharged and a logical low signal is applied to the associated input of NOR gate G1. Thus NOR gates G1 and G2 are latched in the opposite state from that described above in conjunction with the oil response of the sensor. In this state, with the output of NOR gate G2 a logical low, diode CR7 is back biased and therefore has no effect upon the function of the timing circuit including operational amplifier A1. In this state operational amplifier A1 is an oscillator. Operational amplifier A1 continues to produce an output signal equal to the supply voltage, thereby keeping lamp L1 turned on until capacitor C2 is charged to the voltage applied to the noninverting input via the divider circuit. As described above, at this time the output of operational amplifier A1 switches to ground thereby turning off lamp L1. This grounding of the output of operational amplifier A1 switches one terminal of resistor R5 from the positive supply voltage to ground. This has the effect of switching resistor R5 from being in parallel with resistor R4 to being in parallel with resistor R6. The voltage applied to the noninverting input of operational amplifier A1 is thus switched to a lower voltage as defined by the new divider circuit. Because capacitor C2 is charged to a voltage greater than this new reference voltage, the output of operational amplifier A1 remains grounded. Capacitor C2 is then discharged to the grounded output voltage of operational amplifier A1 through resistor R7. This discharging process continues until the voltage across capacitor C2 falls below the new reference voltage applied to the noninverting input. When this occurs, the output of operational amplifier A1 is again switched to the positive supply voltage. This switches resistor R5 from being in parallel with resistor R6 to being in parallel to resistor R4, thereby raising the divider voltage applied to the noninverting input to the initial level. As before, capacitor C2 is charged toward this new reference voltage through the output voltage applied to one end of resistor R7. As a consequence, the output of operational amplifier A1 periodically switches from the positive supply voltage to ground and back in synchronism with the charging and discharging of capacitor C2. Thus lamp L1 flashes on and off giving an indication that the level of oil in the crankcase is below the position of temperature sensitive resistance element S1.

As illustrated in FIG. 5, the circuit illustrated in FIG. 7 also includes a low voltage protector. This low voltage protector operates in conjunction with the previously described circuit including zener diode CR2, resistor R2 and transistor Q3. Any time the supply of voltage drops to the extent that the charge stored in capacitor C1 has a voltage less than the reverse breakdown voltage of zener diode CR2, transistor Q3 is turned off for lack of base bias current. As a result, resistor R6 is open circuited and therefore the the positive supply voltage is supplied to the noninverting input terminal of operational amplifier A1. This prevents the timer from ending its predetermined period of time during a low voltage state because capacitor C2 cannot charge to a voltage greater than the supply voltage less the forward bias voltage drop across diode CR3. In addition, diode CR11 applies a small current to capcitor C6. As a result, a logical high is applied to one input of both NOR gates G1 and G2. Thus the latch circuit is held in its initial state and is prevented from being responsive to any change in the output of the comparator operational amplifier A4. This circuit is employed because in the automotive application contemplated for the circuit illustrated in FIG. 7, the electrical power supply has occasional periods of low voltage. These low voltage periods could trigger a false low oil latching condition because the temperature dependent signal from the sensor network may fall below the temperature reference signal stored on capacitor C5 momentarily during such a low voltage condition. In order to prevent such an occurrence the timer circuit is inhibited from completing its predetermined timed interval and the latch circuit is prevented from entering either latch condition when a low supply voltage condition is detected.

Figure 8:
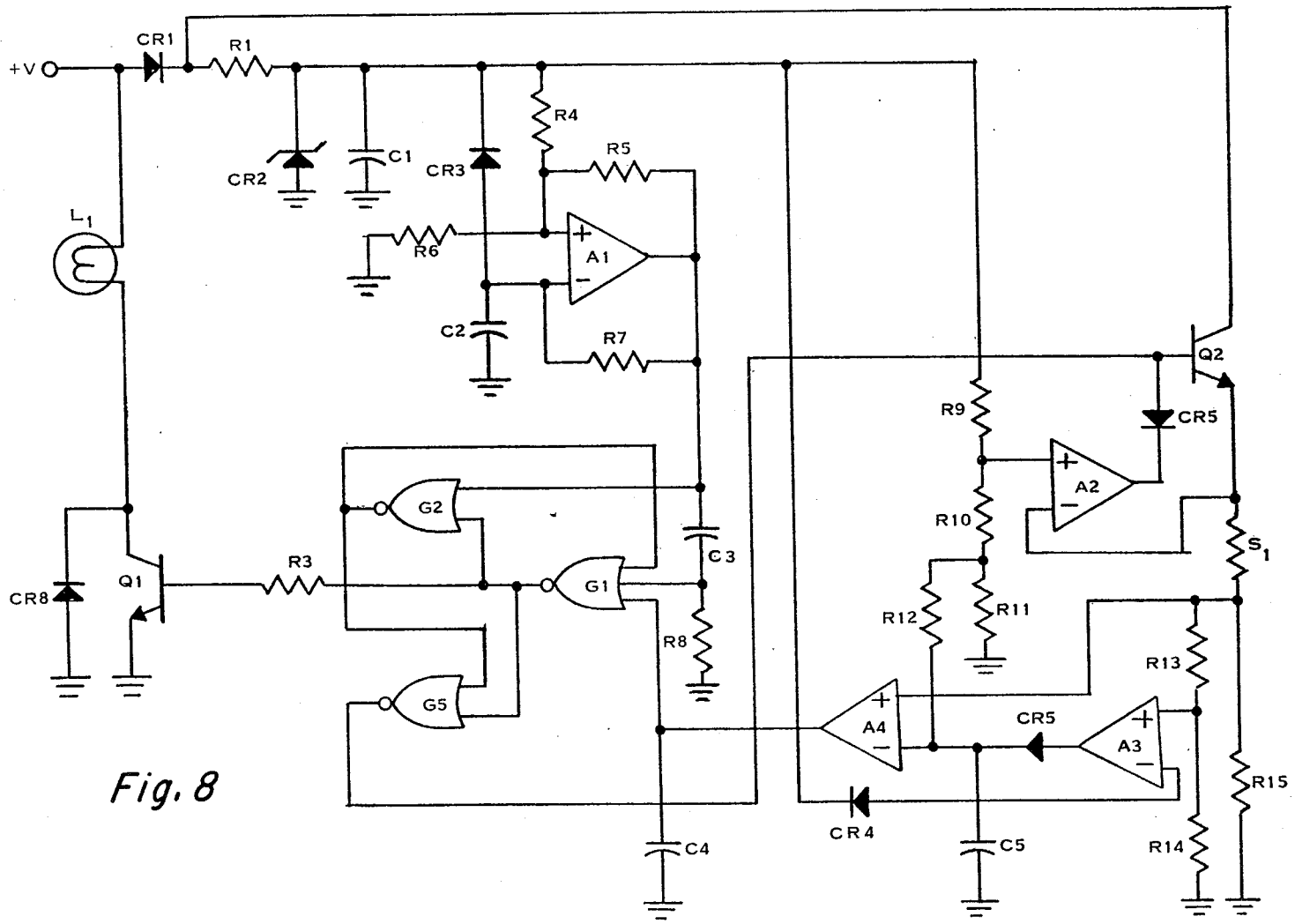
FIG. 8 is a practical circuit diagram of the present invention having a repeated measuring function.

FIG. 8 illustrates a second embodiment of the autoreferencing liquid level sensor of the present invention. Whereas the previous circuit determined the liquid level once when the power was first turned on, the circuit illustrated in FIG. 8 checks the liquid level repeatedly.

The circuit illustrated in FIG. 8 is highly similiar to the previous circuit illustrated in FIG. 7 except for some differences in the timing circuit and the logic circuit. In addition, the circuit illustrated in FIG. 8 does not include a low voltage detector. Upon initial application of power to the circuit, a percentage of the power supply voltage is supplied to the noninverting input of operational amplifier A1 through the divider circuit composed of resistors R4 and R6. Because capacitor C2 is initially discharged, the voltage applied to the noninverting input terminal of operational amplifier A1 is greater than the voltage applied to the inverting input terminal. Therefore, the output of operational amplifier A1 is driven to the positive supply voltage. This applies the logical high signal to one input of NOR gate G2 forcing its input to assume a logical low state. An initial high level input signal is applied to one input of NOR gate G1 from the output of operational amplifier A1 through capacitor C3. Because the outputs of both NOR gates G1 and G2 are logical low signals, these two signals when applied to the inputs of NOR gate G3 causes a logical high output from NOR gate G3. In the manner explained in detail above, transistor Q2 is turned on thereby initiating the sensor heating cycle. In addition, a logical low signal from NOR gate G1 is applied to the base of transistor Q1 through resistor R3. This turns transistor Q1 off therefore lamp L1 is not lit.

In the manner described in greater detail above, capacitor C2 is charged through resistor R7 up the voltage applied to the noninverting input of operational amplifier A1 set by the voltage divider network.

In the case in which the liquid level is above the position of temperature sensitive resistance element S1, then the output of operational amplifier A4 remains at the positive supply voltage throughout the heating period. This is because the temperature dependent signal is always greater than the temperature reference signal (see FIG. 6). When capacitor C2 charges up to the voltage applied to the noninverting input of operational amplifier A1, the output of operational amplifier A1 switches from the positive supply of voltage to ground. This discharges capacitor C3 and applies a logical low signal to one input of both NOR gates G1 and G2. Because NOR gate G1 still has a logical high signal applied to one of its inputs from operational amplifier A4, its output remains a logical low and lamp L1 remains off. However, the two inputs to NOR gate G2 and both now logical low signals. Therefore, the output of NOR gate G2 becomes a logical high signal. This logical high signal is applied to one input of NOR gate G3. Thus NOR gate G3 applies a logical low to the base of transistor Q2 turning off the power to the sensor network. In addition, the logical high output of NOR gate G2 is fed back to NOR gate G1, thereby latching these gates in a state which indicates the liquid level is above the position of the sensor. Capacitor C4 is provided to retain a logical high signal on one input NOR gate G1 until this latching is complete, regardless of the effect of turning off the sensor power on the output of operational amplifier A4.

As noted in detail above, with one input of resistor R6 grounded, the circuitry associated with operational amplifier A1 is an oscillator. Once the output of operational amplifier A1 has switched from the positive supply voltage to ground, the charge stored on capacitor C2 is discharged through resistor R7 to the newly set reference level applied to the noninverting input of operational amplifier A1 from the divider circuit. When this voltage, which is applied to the inverting input of operational amplifier A1, reaches the reference voltage, the output of operational amplifier A1 again becomes the positive supply voltage and capacitor C2 begins to charge to the newly set, higher reference voltage. This new output of operational amplifier A1 applies a logical high signal to the input of NOR gate G1 through the time constant circuit including capacitor C3 and resistor R8. At the same time, this output of operational amplifier A1 applies a logical high to one input of NOR gate G2, thus forcing its output to a logical low level. At this time NOR gate G3 receives two logical low signal inputs. Thus NOR gate G3 produces a logical high output turning on the sensor power via transistor Q2. The time constant of capacitor C3 and resistor R8 is selected so that a logical high signal is reliably applied to the associated input of NOR gate G1 until operational amplifier A4 produces its initial output signal which is equal to the positive supply voltage. This prevents the latch comprising NOR gates G1 and G2 from falsely latching in an improper state. As long as the temperature dependent signal never goes below the temperature reference signal, the circuit osciallates between the two states described above and lamp L1 is never lit.

In the case in which the liquid level is below the position of temperature sensitive resistance element S1, then at some time during each charging period of capacitor C2 the temperature dependence signal falls below the temperature reference signal (see FIG. 6). At this time the output of operational amplifier A4 goes to ground, thereby providing a logical low signal to the associated input of NOR gate G1. At this time the capacitor C3 has been fully charged to the supply voltage from the output of operational amplifier A1 thus no current flows through resistor R8, and therefore a logical low signal is also supplied to the input of NOR gate G1 associated with capacitor C3 and resistor R8. Because the output of NOR gate G2 is also a logical low signal, each of the inputs to NOR gate G1 is a logical low signal. Thus the output of NOR gate G1 becomes a logical high signal. This applies a base bias current to transistor Q1 through resistor R3, thus turning on lamp L1. In addition, this applies a logical high signal to one input of NOR gate G3, thus causing NOR gate G3 to produce a logical low output signal turning off the base bias current to transistor Q2 and thus the sensor power. Again because capacitor C3 is fully charged up to the positive supply voltage, the output of operational amplifier A1 has no effect upon the output of NOR gate G1. Thus NOR gates G1 and G2 are latched in a state indicating a low liquid level and lamp L1 is on. The logical state of NOR gates G1 and G2 is not changed when the output of operational amplifier A1 switches to ground when the charge on capacitor C2 reaches the reference voltage. During the time in which the charge on capacitor C2 is discharged through resistor R7 toward the new reference voltage in a manner fully described above, the logical states of NOR gates G1 and G2 remain unchanged and thus lamp L1 continues to be lit. When the voltage on capacitor C2 falls below the reference voltage on the noninverting input of operational amplifier A1, the output of operational amplifier A1 becomes the positive supply voltage. This output of operational amplifier A1 resets the logical states of NOR gates G1, G2 and G3 in a manner similar to that upon first turn on of the system. Thus a base bias is applied to transistor Q2, electrical power is applied to the sensor network and no base bias current is applied to transistor Q1 thus shutting lamp L1 off. This state continues until the temperature dependent signal again falls below the temperature reference signal in the manner described above. Thus in the case in which the liquid level is below the position of temperature sensitive resistance element S1, the lamp L1 flashes on and off with the length of the off period related to the length of time necessary for the temperature dependent signal from the heated sensor to cross the temperature reference signal. This flashing of the lamp can be clearly distinguished from the case in which the liquid is above the position of temperature dependent resistance S1 in which the lamp is never lit.

What is claimed is:

1. An autoreferencing liquid level sensing apparatus comprising:

a temperature sensitive resistance element including a silicon bulk resistor element having an impurity concentration level for causing said silicon bulk resistor element to exhibit a positive temperature coefficient of resistance within a predetermined temperature range and first and second electrodes in ohmic contact with said silicon bulk resistor, said temperature sensitive resistance element being disposed at a position whereat the presence of a liquid is to be determined;

a timing means for generating an enabling signal for a predetermined period of time;

an electric power source connected to said temperature sensitive resistance element and said timing means for applying a predetermined amount of electric power to said temperature sensitive resistance element via said first and second electrodes when said enabling signal is generated;

a resistance measuring means connected to said temperature sensitive resistance element for generating a temperature dependent signal corresponding to the electrical resistance of said temperature sensitive resistance element;

a temperature reference means connected to said timing means and said reference measuring means for generating a temperature reference signal having an initial value and a rate of change, each related to the temperature dependent signal at the beginning of said predetermined period of time;

a comparison means connected to said resistance measuring means and said temperature reference means for generating a comparison output signal whenever said temperature dependent signal and said temperature reference signal have a predetermined relationship; and a latch means connected to said timing means and said comparison means for generating a latch output signal if said enabling signal and said comparison output signal are ever generated simultaneously.

2. An autoreferencing liquid level sensing apparatus as claimed in claim 1, further comprising:

a voltage regulator means having a means for receiving electric power and a means for supplying electric power at a first predetermined voltage to at least said electric power source whenever the received electric power has a voltage greater than a second predetermined voltage; and a low voltage disabling means connected to said latch means and said voltage regulator means for disabling said latch means whenever the electric power received by said voltage regulator means has a voltage less than said second predetermined voltage.

3. An autoreferencing liquid level sensing apparatus as claimed in claim 1, further comprising:

an electric power source disabling means connected to said electric power source and said latch means for disabling said electric power source from applying electric power to said temperature sensitive resistance element whenever said latch output signal is generated.

4. An autoreferencing liquid level sensing apparatus comprising:

a temperature sensitive resistance element including a silicon bulk resistor element having an impurity concentration level for causing said silicon bulk resistor element to exhibit a positive temperature coefficient of resistance within a predetermined temperature range and first and second electrodes in ohmic contact with said silicon bulk resistor, said temperature sensitive resistance element being disposed at a position whereat the presence of a liquid is to be determined;

a timing means for repetitively generating an enabling signal during a first predetermined period of time and a disabling signal during a second predetermined period of time;

an electric power source connected to said temperature sensitive resistance element and said timing means for applying a predetermined amount of electric power to said temperature sensitive resistance element via said first and second electrodes when said enabling signal is generated and for applying no electric power to said temperature sensitive resistance element when said disabling signal is generated;

a resistance measuring means connected to said temperature sensitive resistance element for generating a temperature dependent signal corresponding to the electrical resistance of said temperature sensitive resistance element;

a temperature reference means connected to said timing means and said resistance measuring means for generating a temperature reference signal having an initial value and a rate of change, each related to the temperature dependent signal at the beginning of said first predetermined period of time;

a comparison means connected to said resistance measuring means and said temperature reference means for generating a comparison output signal whenever said temperature dependent signal and said temperature reference signal have a predetermined relationship; and a latch means connected to said timing means and said comparison means for generating a latch output signal if said enabling signal and said comparison output signal are ever generated simultaneously, said latch means being reset at the beginning of each first predetermined period of time.

5. An autoreferencing liquid level sensing apparatus as claimed in claim 4, further comprising:

a voltage regulator means having a means for receiving electric power and a means for supplying electric power at a first predetermined voltage to at least said electric power source whenever the received electric power has a voltage greater than a second predetermined voltage; and a low voltage disabling means connected to said latch means and said voltage regulator means for disabling said latch means whenever the electric power received by said voltage regulator means has a voltage less than said second predetermined voltage.

6. An autoreferencing liquid level sensing apparatus as claimed in claim 4, further comprising:

an electric power source disabling means connected to said electric power source and said latch means for applying a disabling signal to said electric power source whenever said latch output signal is generated.

* * * * *